US009801516B2

(12) United States Patent
Zheng et al.

(10) Patent No.: US 9,801,516 B2
(45) Date of Patent: Oct. 31, 2017

(54) SURFACE CLEANING APPLIANCE

(71) Applicant: Dyson Technology Limited, Wiltshire (GB)

(72) Inventors: Libo Zheng, Swindon (GB); Yongji Zhou, Swindon (GB); James Douglas Chisholm, Swindon (GB); David John Hawker, Bristol (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 364 days.

(21) Appl. No.: 14/304,619

(22) Filed: Jun. 13, 2014

(65) Prior Publication Data

US 2014/0366286 A1 Dec. 18, 2014

(30) Foreign Application Priority Data

Jun. 13, 2013 (GB) ..... 1310571.3

(51) Int. Cl.
*A47L 11/40* (2006.01)
*A47L 9/28* (2006.01)

(52) U.S. Cl.
CPC ..... *A47L 11/4011* (2013.01); *A47L 9/2831* (2013.01); *A47L 9/2847* (2013.01); *A47L 9/2857* (2013.01); *A47L 11/4008* (2013.01); *A47L 11/4069* (2013.01)

(58) Field of Classification Search
CPC .... A47L 9/2857; A47L 9/2831; A47L 9/2847; A47L 11/00; A47L 11/4011; A47L 11/4008; A47L 11/4069
See application file for complete search history.

(56) References Cited

U.S. PATENT DOCUMENTS 5,323,483 A * 6/1994 Baeg ..... A47L 9/2815 15/319
9,131,820 B2 * 9/2015 Danestad ..... A47L 9/2831
2002/0175648 A1 * 11/2002 Erko ..... A47L 11/14 318/560
2007/0061058 A1 * 3/2007 Gordon ..... A47L 5/28 701/23
2010/0229892 A1 * 9/2010 Reese ..... A47L 11/33 134/6

(Continued)

FOREIGN PATENT DOCUMENTS

WO WO-2009/105698 8/2009

OTHER PUBLICATIONS

Search Report dated Sep. 19, 2013 directed towards GB Application No. 1310571.3; 1 page.

(Continued)

*Primary Examiner* — Robert Scruggs
(74) *Attorney, Agent, or Firm* — Morrison & Foerster LLP

(57) ABSTRACT

A surface cleaning appliance having a cleaner head that includes an agitator and a motor for driving the agitator. The appliance includes a switch coupling the motor to a supply voltage, a voltage sensor for measuring the magnitude of the supply voltage, a current sensor for measuring the magnitude of current through the motor, and a controller configured to output a PWM signal for controlling the switch. The controller then adjusts the duty cycle of the PWM signal in response to changes in the supply voltage and in response to changes in the current through the motor.

12 Claims, 9 Drawing Sheets

(56) References Cited

U.S. PATENT DOCUMENTS

2015/0150427 A1* 6/2015 Danestad ..... H02P 7/00
318/139

OTHER PUBLICATIONS

International Search Report and Written Opinion dated Sep. 19, 2014 directed towards PCT Application No. PCT/GB2014/051780; 7 pages.

* cited by examiner

| Control Signals | | | | Power Switches | | | | Inverter Condition |
|---|---|---|---|---|---|---|---|---|
| S1 | S2 | S3 | S4 | Q1 | Q2 | Q3 | Q4 | |
| 0 | 0 | 0 | 0 | 0 | 0 | 0 | 0 | Off |
| 1 | 0 | 0 | 1 | 1 | 0 | 0 | 1 | Excite Left-to-Right |
| 0 | 1 | 1 | 0 | 0 | 1 | 1 | 0 | Excite Right-to-Left |
| 0 | 1 | 0 | 1 | 0 | 1 | 0 | 1 | Freewheel |

| Supply Voltage (V) | Register Value (HEX) |
|---|---|
| 16.8 | F7 |
| 16.9 | F5 |
| 17.0 | F4 |
| 17.1 | F3 |
| 17.2 | F1 |
| ⋮ | ⋮ |
| 23.7 | AF |
| 23.8 | AE |
| 23.9 | AE |
| 24.0 | AD |
| 24.1 | AC |

| Duty Cycle (%) | Input Voltage (V) |
|---|---|
| 96.48 | 16.21 |
| 95.70 | 16.17 |
| 95.31 | 16.20 |
| 94.92 | 16.23 |
| 94.14 | 16.19 |
| ⋮ | ⋮ |
| 68.36 | 16.20 |
| 67.97 | 16.18 |
| 67.97 | 16.24 |
| 67.58 | 16.22 |
| 67.19 | 16.19 |

Fig. 12

| | Supply Voltage (V) | | | | |
|---|---|---|---|---|---|
| Motor Current (A) | 16.8 – 17.6 | 17.7 – 18.4 | ... | 22.5 – 23.2 | 23.3 – 24.1 |
| 0.000 – 0.424 | 0x01 | 0x01 | ... | 0x01 | 0x01 |
| 0.424 – 0.848 | 0x01 | 0x02 | ... | 0x01 | 0x01 |
| 0.848 – 1.273 | 0x02 | 0x02 | ... | 0x02 | 0x02 |
| 1.273 – 1.697 | 0x02 | 0x03 | ... | 0x02 | 0x02 |
| 1.697 – 2.1211 | 0x03 | 0x03 | ... | 0x03 | 0x02 |
| 2.121 – 2.5451 | 0x04 | 0x04 | ... | 0x03 | 0x03 |
| 2.545 – 2.970 | 0x04 | 0x04 | ... | 0x03 | 0x03 |
| 2.970 – 3.394 | 0x05 | 0x05 | ... | 0x04 | 0x04 |
| 3.394 – 3.818 | 0x06 | 0x06 | ... | 0x04 | 0x04 |
| 3.818 – 4.242 | 0x06 | 0x06 | ... | 0x05 | 0x04 |

Fig. 13

SURFACE CLEANING APPLIANCE

REFERENCE TO RELATED APPLICATION

This application claims priority of United Kingdom Application No. 1310571.3, filed Jun. 13, 2013, the entire contents of which are incorporated herein by reference.

FIELD OF THE INVENTION

The present invention relates to a surface cleaning appliance.

BACKGROUND OF THE INVENTION

A surface cleaning appliance, such as a vacuum cleaner, may comprise a cleaner head having an agitator driven by a motor. Changes in the supply voltage used to power the motor are likely to influence the performance of the motor. As a result, the cleaning performance of the appliance may be inconsistent.

SUMMARY OF THE INVENTION

The present invention provides a surface cleaning appliance comprising a cleaner head comprising an agitator and a motor for driving the agitator, a switch coupling the motor to a supply voltage, a voltage sensor for measuring the magnitude of the supply voltage, a current sensor for measuring the magnitude of current through the motor, and a controller configured to output a PWM signal for controlling the switch, wherein the controller adjusts the duty cycle of the PWM signal in response to changes in the supply voltage and in response to changes in the motor current.

By varying the duty cycle of the PWM signal in response to changes in both the supply voltage and the motor current, a more consistent performance may be achieved for the motor. For a given load, the speed of the motor may be proportional to the input voltage to the motor. Accordingly, by adjusting the duty cycle of the PWM signal in response to changes in the supply voltage, better control may be achieved over the speed of the motor. In particular, the controller may adjust the duty cycle such that, for a given load, the speed of the motor is constant over a range of different supply voltages. Owing to Ohmic losses, there is a voltage drop across electrical components connected in series with the motor. This voltage drop is proportional to the magnitude of the motor current, which varies as the load on the motor varies. Consequently, the input voltage to the motor is sensitive to changes in load. By adjusting the duty cycle of the PWM signal in response to changes in the motor current, better control over the speed of the motor may be achieved when operating at different loads. In particular, the controller may adjust the duty cycle in response to changes in the supply voltage and the motor current such that the same torque-speed curve is maintained over a range of different supply voltages.

The controller may adjust the duty cycle of the PWM signal so as to maintain a constant input voltage to the motor over a range of different supply voltages and over a range of different motor currents. As a result, the performance of the motor is unaffected by changes in the supply voltage.

For a given duty cycle, the input voltage to the motor decreases as the supply voltage deceases. Accordingly, the controller may increase the duty cycle in response to a decrease in the supply voltage. As the current through the motor increases, the voltage drop across those components connected in series with the motor increases and thus the input voltage to the motor decreases. Accordingly, the controller may increase the duty cycle in response to an increase in the motor current.

When the switch is closed, the voltage drop across the series-connected components is proportional to the motor current. However, when the switch is open, the voltage drop across the series-connected components is zero. The voltage drop, when averaged over each cycle of the PWM signal, therefore depends on the current and on the duty cycle of the PWM signal, which in turns depends on the supply voltage. Accordingly, when adjusting the duty cycle in response to changes in the current, the controller may adjust the duty cycle by an amount that depends not only on the change in the motor current but also on the magnitude of the supply voltage. That is to say that, in response to a given change in the motor current, the controller may adjust the duty cycle by an amount that depends on the magnitude of the supply voltage. More particularly, the controller may adjust the duty cycle by a larger amount in response to a lower supply voltage. As a result, differences in the torque-speed curve of the motor when operating at different supply voltages may be reduced. In particular, by ensuring that the input voltage to the motor is constant, the same torque-speed curve may be achieved at different supply voltages.

The controller may store a voltage lookup table and a current lookup table, and the controller may index the voltage lookup table using the measured supply voltage to select a first value, and the controller may index the current lookup table using the measured motor current to select a second value. The duty cycle is then defined by the sum of the first value and the second value. This then has the advantage that a duty cycle, which depends on both the supply voltage and the motor current, may be obtained in a relatively simple manner. In particular, it is not necessary to solve a potentially complex equation. As a result, a relatively simple and thus cheap controller may be employed.

For reasons noted above, when adjusting the duty cycle in response to changes in the motor current, it may be desirable to adjust the duty cycle by an amount that also depends on the supply voltage. Accordingly, the current lookup table may store different values for different motor currents and for different supply voltages. The controller then indexes the current lookup table using the measured motor current and the measured supply voltage to select the second value. Rather than storing a voltage lookup table and a current lookup table, the controller could conceivably store a single larger two-dimensional lookup table. However, the advantage of storing two lookup tables is that different voltage resolutions may be used for the voltage lookup table and for the current lookup table. In particular, a finer voltage resolution may be used for the voltage lookup table, and a coarser voltage resolution may be used for the current lookup table. As a result, relatively good control over the input voltage may be achieved through the use of smaller lookup tables, which then reduces the memory requirements of the controller.

When the motor is stationary, a relatively high inrush current will be drawn by the motor if the duty cycle of the PWM signal is relatively high. Accordingly, the controller may employ a predefined duty cycle when the motor is stationary. The controller may then periodically increase the duty cycle by a fixed amount until the duty cycle is equal to or greater than a target duty cycle, which is determined using the measured supply voltage and the measured motor current.

The appliance may comprise a battery pack that provides the supply voltage. As the battery pack discharges, the supply voltage naturally decreases. The controller then adjusts the duty cycle of the PWM signal such that the performance of the motor is relatively consistent as the battery pack discharges.

BRIEF DESCRIPTION OF THE DRAWINGS

In order that the present invention may be more readily understood, an embodiment of the invention will now be described, by way of example, with reference to the accompanying drawings, in which:

FIG. 12 details a portion of a voltage lookup table employed by the controller of the circuit assembly when controlling the brushed motors of the cleaner heads; and FIG. 13 details a portion of a current lookup table employed by the controller of the circuit assembly when controlling the brushed motors of the cleaner heads.

DETAILED DESCRIPTION OF THE INVENTION

Figure 1:
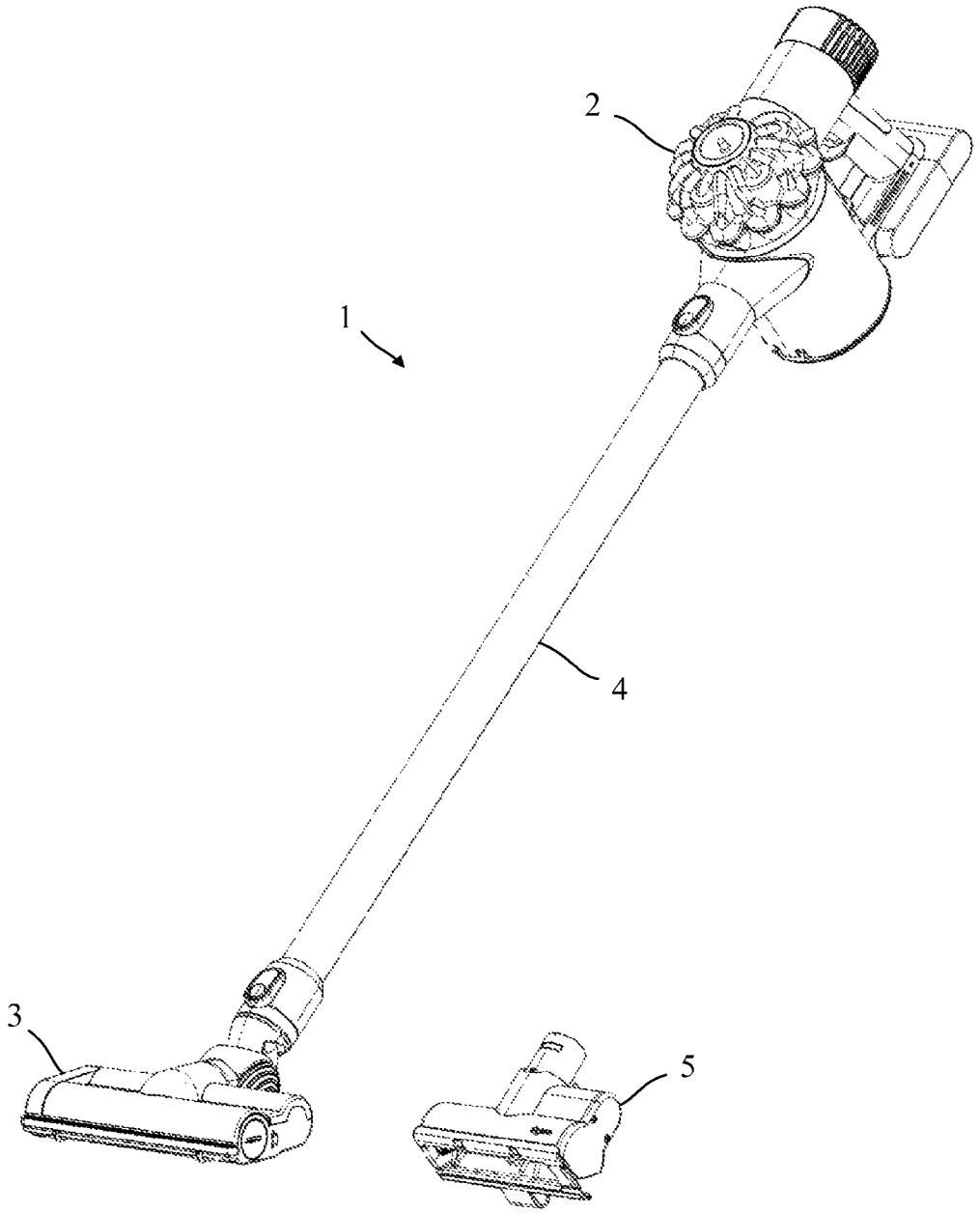
FIG. 1 is an axonometric view of a vacuum cleaner in accordance with the present invention, wherein the main body of the vacuum cleaner is attached to a first cleaner head.

The vacuum cleaner 1 of FIGS. 1 to 6 comprises a main body 2 to which a cleaner head 3 is attached by means of an elongate tube 4. The main body 2 comprises a dirt separator 6, a suction source 7, a circuit assembly 8 and a battery pack 9. During use, dirt-laden air is drawn in through the cleaner head 3 and carried to the dirt separator via the tube 4. Dirt is then separated from the air and retained by the dirt separator 6. The cleansed air is then drawn through the suction source 7 and exhausted from the cleaner 1.

Figure 2:
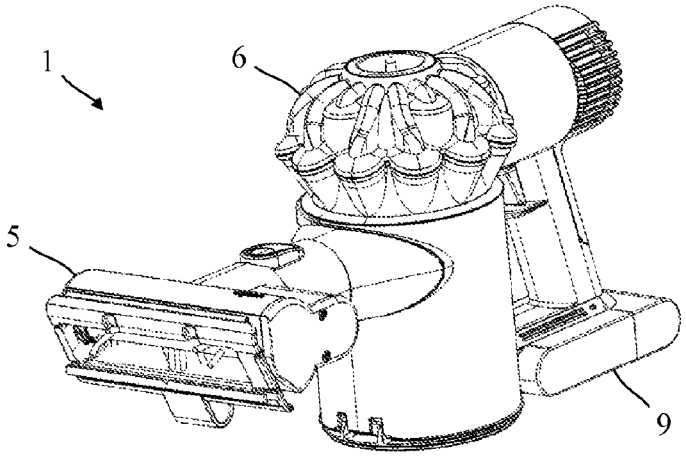
FIG. 2 is a further axonometric view of the vacuum cleaner, wherein the main body is attached to a second cleaner head.
Figure 3:
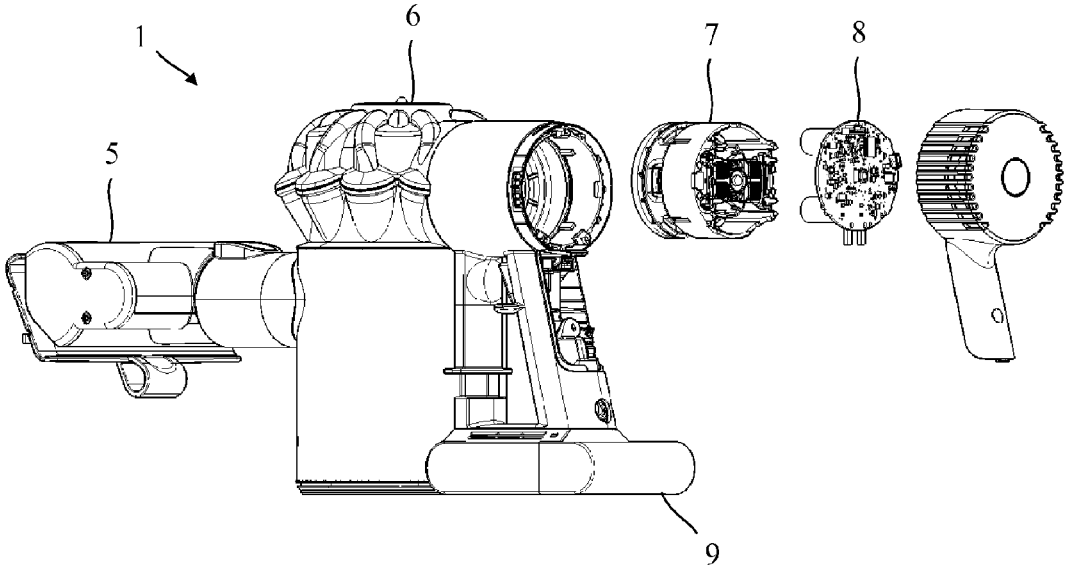
FIG. 3 is an exploded view of the vacuum cleaner.
Figure 4:
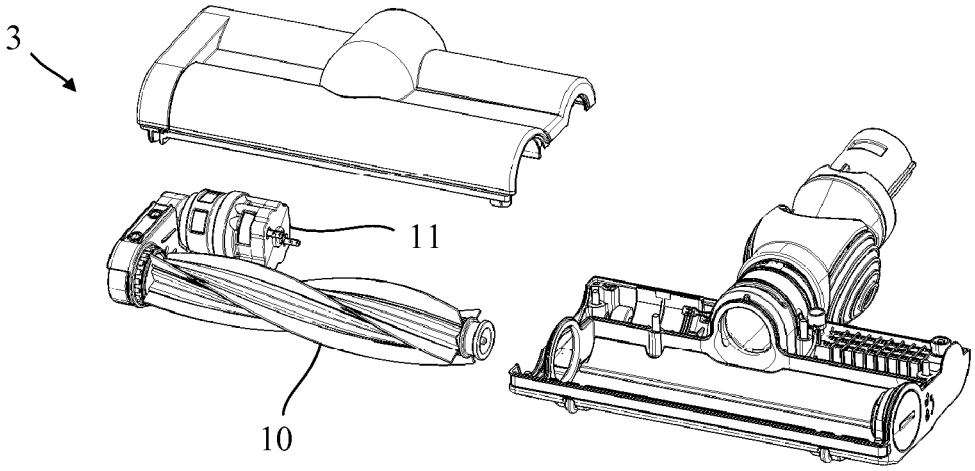
FIG. 4 is an exploded view of the first cleaner head.
Figure 5:
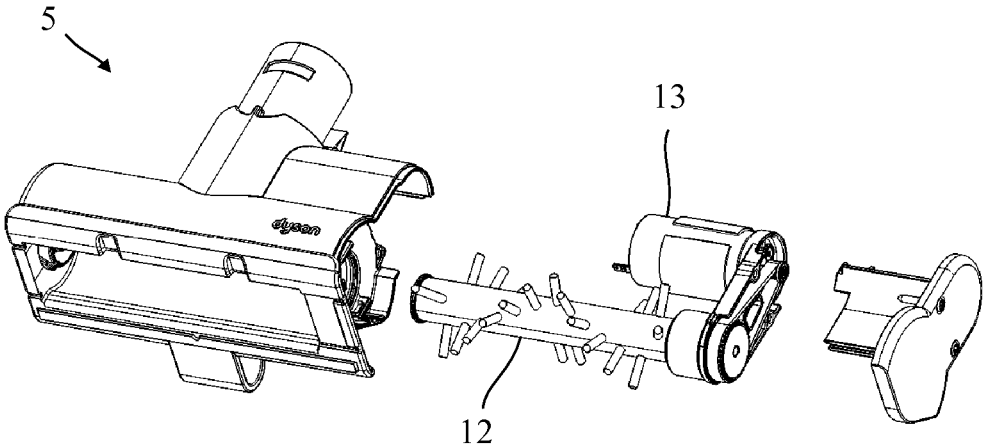
FIG. 5 is an exploded view of the second cleaner head.

The cleaner head 3 and the tube 4 are detachable from the main body 2. Moreover, the vacuum cleaner 1 comprises a second cleaner head 5 that may be attached directly to the main body 2. As a result, the vacuum cleaner 1 may be used as an upright or stick cleaner (i.e. with the first cleaner head 3 and tube 4 attached to the main body 2 as shown in FIG. 1) or as a handheld cleaner (i.e. with the second cleaner head 5 attached directly to the main body 2 as shown in FIG. 2). As illustrated in FIGS. 3 and 4, the two cleaner heads 3,5 each comprise an agitator 10,12 and a brushed motor 11,13 for driving the agitator 10,12. The tube 4 then comprises wires (not shown) that extend along the length of the tube 4 for carrying electrical power from the main body 2 to the first cleaner head 3.

The suction source 7 comprises an impeller 14 and a brushless motor 15 for driving the impeller 14. The brushless motor 15 comprises a four-pole permanent-magnet rotor 16 that rotates relative to a four-pole stator 17. Wires wound about the stator 17 are coupled together to form a single phase winding 18.

Figure 7:
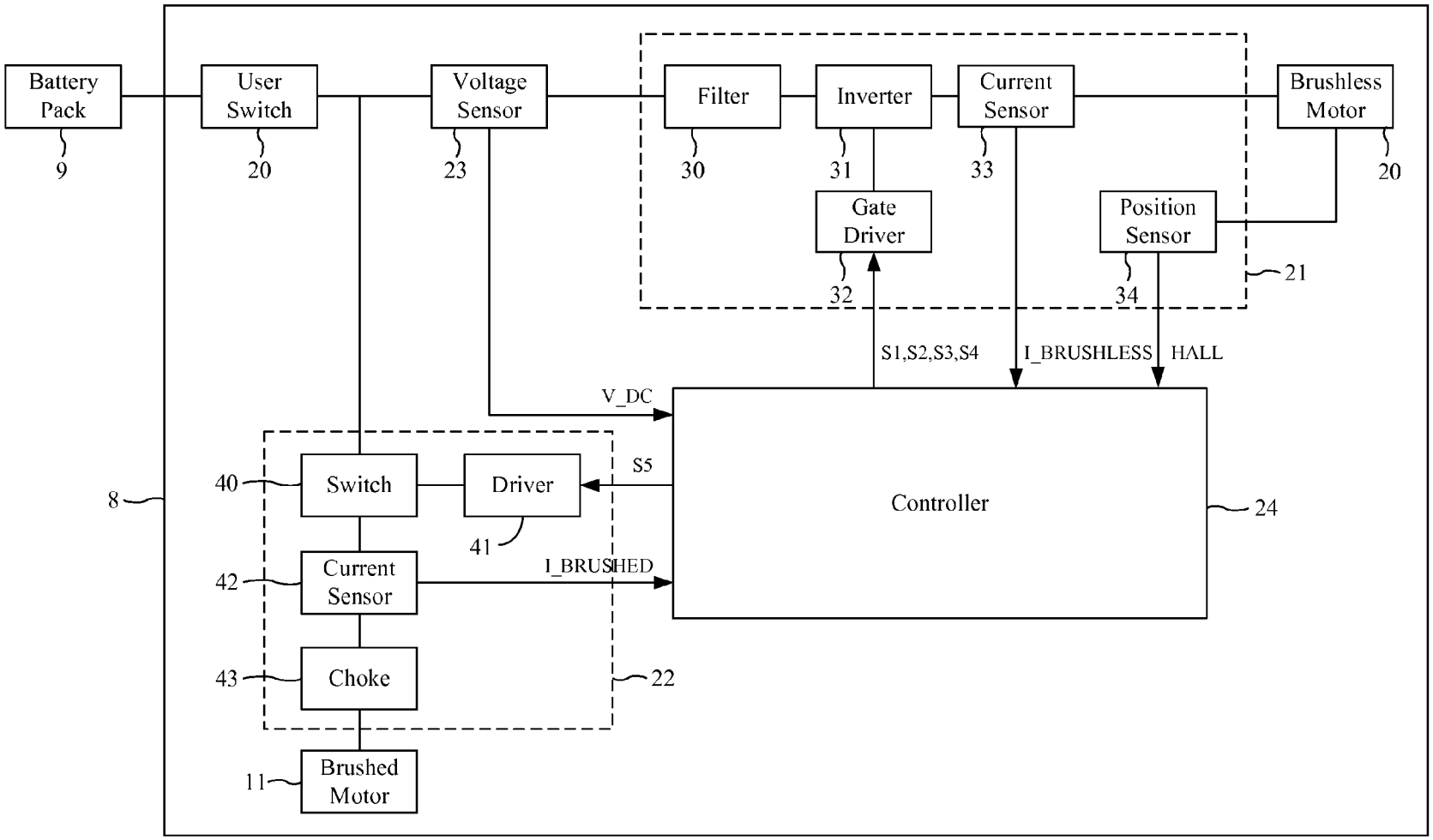
FIG. 7 is a block diagram of the circuit assembly of the vacuum cleaner.
Figure 8:
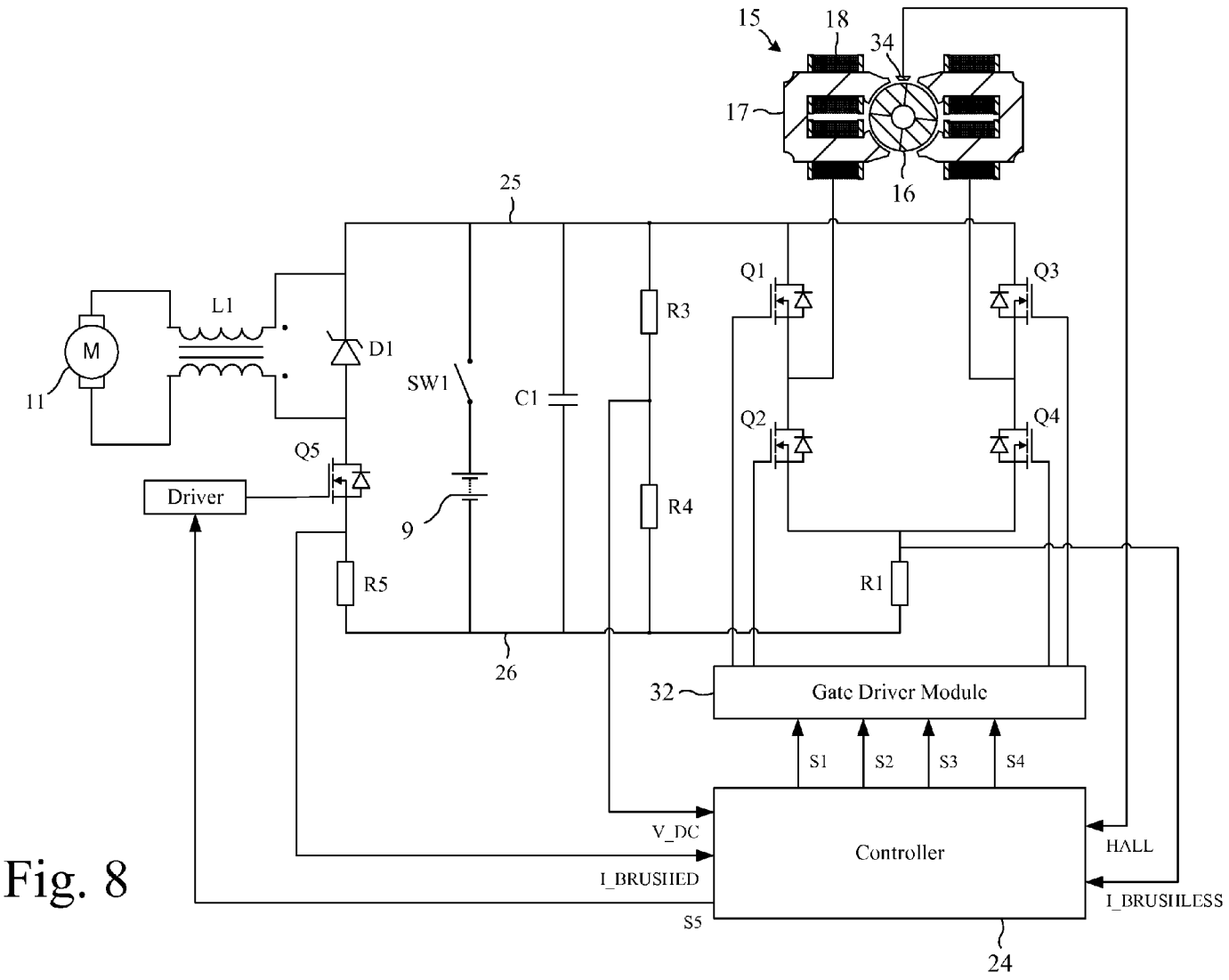
FIG. 8 is a schematic diagram of the circuit assembly.

Referring now to FIGS. 7 and 8, the circuit assembly 8 is responsible for controlling the operation of the vacuum cleaner 1 and comprises a user-operable switch 20, a first drive circuit 21, a second drive circuit 22, a voltage sensor 23 and a controller 24.

The user-operable switch 20 (SW1 in FIG. 8) and the battery pack 9 are connected in series between two voltage rails 25,26 that serve to power the two drive circuits 21,22. The switch 20 is thus used to power on and off the vacuum cleaner 1.

The first drive circuit 21 is responsible for driving the brushless motor 15 of the suction source 7 and comprises a filter 30, an inverter 31, a gate driver module 32, a first current sensor 33, and a position sensor 34. The filter 30 comprises a link capacitor C1 that smoothes the relatively high-frequency ripple that arises from switching of the inverter 31. The inverter 31 comprises a full bridge of four power switches Q1-Q4 that couple the phase winding 18 to the voltage rails 25,26. The gate driver module 32 drives the opening and closing of the power switches Q1-Q4 in response to control signals received from the controller 24. The current sensor 33 comprises a shunt resistor R1 located between the inverter 31 and the zero-volt rail 26. The voltage across the current sensor 33 therefore provides a measure of the current in the phase winding 18. The voltage across the current sensor 33 is output to the controller 24 as signal, I_BRUSHLESS. The position sensor 34 comprises a Hall-effect sensor located in a slot opening of the stator 17. The sensor 34 outputs a digital signal, HALL, that is logically high or low depending on the direction of magnetic flux through the sensor 34. The HALL signal therefore provides a measure of the angular position of the rotor 16.

The second drive circuit 22 is responsible for driving the brushed motor 11,13 of either cleaner head 3,5 and comprises a switch 40, a driver 41, a second current sensor 42, and a choke circuit 43. The choke circuit 43, the switch 40 and the current sensor 42 are arranged in series between the two voltage rails 25,26. The switch 40 takes the form of a power switch Q5 that is driven open and closed by the driver 41 in response to a control signal S5 received from the controller 24. The second current sensor 42 comprises a shunt resistor R2 located between the power switch Q5 and the zero-volt rail 26. The voltage across the shunt R2 provides a measure of the current in the brushed motor 11 and is output to the controller as signal, I_BRUSHED. The choke circuit 43 comprises a common-mode choke L1 and a diode D1 arranged in parallel with the choke L1. The output of the choke L1 is coupled to the terminals of the brushed motor 11. The loop provided by the choke L1 and the diode D1 enables current in the brushed motor 11 to freewheel when the power switch Q5 is open.

The voltage sensor 23 comprises a potential divider R3,R4 located between the two voltage rails 25,26. The voltage sensor outputs a signal, V_DC, to the controller 24 which represents a scaled-down measure of the DC voltage provided by the battery pack 9.

The controller 24 comprises a microcontroller having a processor, a memory device, and a plurality of peripherals (e.g. ADC, comparators, timers etc.). The memory device stores instructions for execution by the processor, as well as control parameters and lookup tables that are employed by the processor during operation. The controller 24 is responsible for controlling the operation of the two motors 11,15. To this end, the controller 24 outputs four control signals S1-S4 for controlling the power switches Q1-Q4 of the first drive circuit 21, and a further control signal S5 for controlling the power switch Q5 of the second drive circuit 22. The control signals S1-S4 are output to the gate driver module 32 of the first drive circuit 21 and the control signal S5 is output to driver 41 of the second drive circuit 22.

Control of the Brushless Motor

Figures 6, 9:
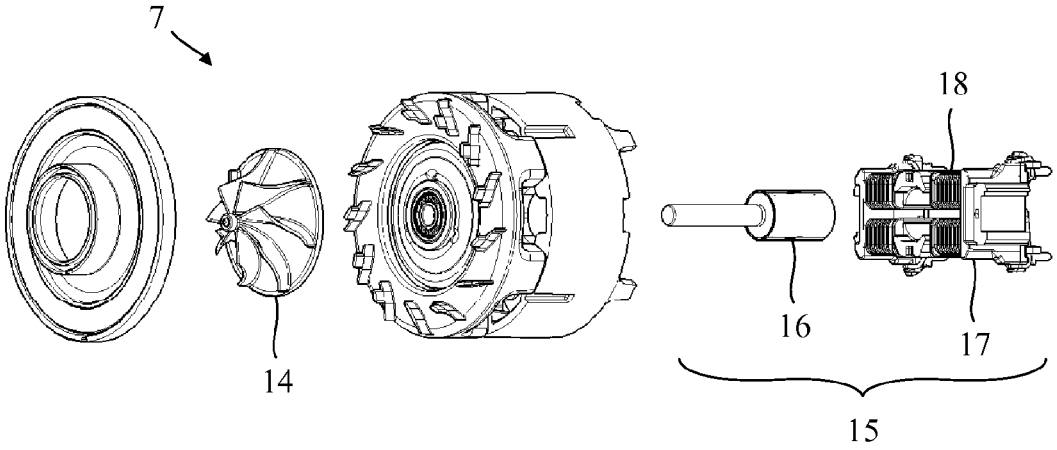
FIG. 6 is an exploded view of the suction source of the vacuum cleaner.
FIG. 9 details the allowed states of an inverter in response to control signals issued by a controller of the circuit assembly.

FIG. 9 summarises the allowed states of the switches Q1-Q4 in response to the control signals S1-S4 output by the controller 24. Hereafter, the terms 'set' and 'clear' will be used to indicate that a signal has been pulled logically high and low respectively. As can be seen from FIG. 9, the controller 24 sets S1 and S4, and clears S2 and S3 in order to excite the phase winding 18 from left to right. Conversely, the controller 24 sets S2 and S3, and clears S1 and S4 in order to excite the phase winding 18 from right to left. The controller 24 clears S1 and S3, and sets S2 and S4 in order to freewheel the phase winding 18. Freewheeling enables current in phase the winding 18 to re-circulate around the low-side loop of the inverter 31. In the present embodiment, the power switches Q1-Q4 are capable of conducting in both directions. Accordingly, the controller 24 closes both low-side switches Q2,Q4 during freewheeling such that current flows through the switches Q2,Q4 rather than the less efficient diodes. Conceivably, the inverter 31 may comprise power switches that conduct in a single direction only. In this instance, the controller 24 would clear S1, S2 and S3, and set S4 so as to freewheel the phase winding 18 from left to right. The controller 24 would then clear S1, S3 and S4, and set S2 in order to freewheel the phase winding 18 from right to left. Current in the low-side loop of the inverter 31 then flows down through the closed low-side switch (e.g. Q4) and up through the diode of the open low-side switch (e.g. Q2).

The controller 24 operates in one of two modes depending on the speed of the rotor 16. At speeds below a predefined threshold, the controller 24 operates in acceleration mode. At speeds at or above the threshold, the controller 24 operates in steady-state mode. The speed of the rotor 16 is determined from the interval, T_HALL, between two successive edges of the HALL signal. This interval will hereafter be referred to as the HALL period.

In each mode the controller 24 commutates the phase winding 18 in response to edges of the HALL signal. Each HALL edge corresponds to a change in the polarity of the rotor 16, and thus a change in the polarity of the back EMF induced in the phase winding 18. More particularly, each HALL edge corresponds to a zero-crossing in the back EMF. Commutation involves reversing the direction of current through the phase winding 18. Consequently, if current is flowing through the phase winding 18 in a direction from left to right, commutation involves exiting the winding from right to left.

Acceleration Mode

When operating in acceleration mode, the controller 24 commutates the phase winding 18 in synchrony with the edges of the HALL signal. Over each electrical half-cycle, the controller 24 sequentially excites and freewheels the phase winding 18. More particularly, the controller 24 excites the phase winding 18, monitors the current signal, I_BRUSHLESS, and freewheels the phase winding 18 when the current in the phase winding 18 exceeds a predefined limit Freewheeling then continues for a predefined freewheel period during which time current in the phase winding 18 falls to a level below the current limit Δt the end of the freewheel period the controller 24 again excites the phase winding 18. This process of exciting and freewheeling the phase winding 18 continues over the full length of the electrical half-cycle. The controller 24 therefore switches from excitation to freewheeling multiple times during each electrical half-cycle.

Figure 10:
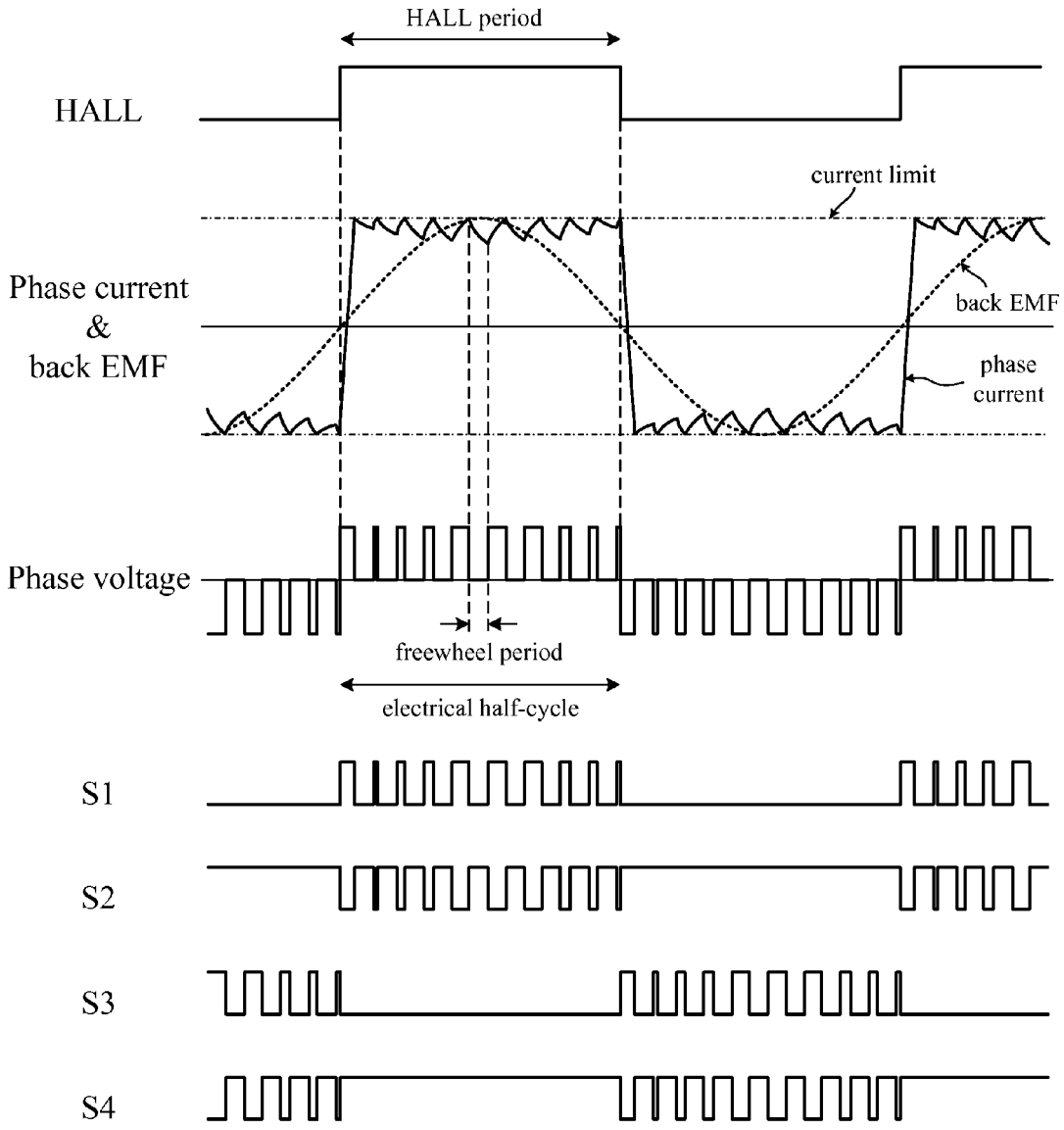
FIG. 10 illustrates various waveforms relating to the brushless motor of the suction source when operating in acceleration mode.

FIG. 10 illustrates the waveforms of the HALL signal, the back EMF, the phase current, the phase voltage, and the control signals S1-S4 over a couple of HALL periods when operating in acceleration mode.

At relatively low speeds, the magnitude of the back EMF induced in the phase winding 18 is relatively small. Current in the phase winding 18 therefore rises relatively quickly during excitation, and falls relatively slowly during freewheeling. Additionally, the length of each HALL period and thus the length of each electrical half-cycle is relatively long. Consequently, the frequency at which the controller 24 switches from excitation to freewheeling is relatively high. However, as the rotor speed increases, the magnitude of the back EMF increases and thus current rises at a slower rate during excitation and falls at a quicker rate during freewheeling. Additionally, the length of each electrical half-cycle decreases. As a result, the frequency of switching decreases.

Steady-State Mode

When operating in steady-state mode, the controller 24 may advance, synchronise or retard commutation relative to each HALL edge. In order to commutate the phase winding 18 relative to a particular HALL edge, the controller 24 acts in response to the preceding HALL edge. In response to the preceding HALL edge, the controller 24 subtracts a phase period, T_PHASE, from the HALL period, T_HALL, in order to obtain a commutation period, T_COM:

$$T_COM = T_HALL - T_PHASE$$

The controller 24 then commutates the phase winding 18 at a time, T_COM, after the preceding HALL edge. As a result, the controller 24 commutates the phase winding 18 relative to the subsequent HALL edge by the phase period, T_PHASE. If the phase period is positive, commutation occurs before the HALL edge (advanced commutation). If the phase period is zero, commutation occurs at the HALL edge (synchronous commutation). And if the phase period is negative, commutation occurs after the HALL edge (retarded commutation).

Advanced commutation is employed at higher rotor speeds, whilst retarded commutation is employed at lower rotor speeds. As the speed of the rotor 16 increases, the HALL period decreases and thus the time constant (L/R) associated with the phase inductance becomes increasingly important. Additionally, the back EMF induced in the phase winding 18 increases, which in turn influences the rate at which phase current rises. It therefore becomes increasingly difficult to drive current and thus power into the phase winding 18. By commutating the phase winding 18 in advance of a HALL edge, and thus in advance of a zero-crossing in back EMF, the supply voltage is boosted by the back EMF. As a result, the direction of current through the phase winding 18 is more quickly reversed. Additionally, the phase current is caused to lead the back EMF, which helps to compensate for the slower rate of current rise. Although this then generates a short period of negative torque, this is normally more than compensated by the subsequent gain in positive torque. When operating at lower speeds, it is not necessary to advance commutation in order to drive the required current into the phase winding 18. Moreover, optimum efficiency is typically achieved by retarding commutation.

When operating in steady-state mode, the controller 24 divides each electrical half-cycle into a conduction period followed by a freewheel period. The controller 24 then excites the phase winding 18 during the conduction period and freewheels the phase winding 18 during the freewheel period. When operating within steady-state mode, the phase current is not expected to exceed the current limit during excitation. Consequently, the controller 24 switches from excitation to freewheeling only once during each electrical half-cycle.

The controller 24 excites the phase winding 18 for a conduction period, T_CD. At the end of the conduction period, the controller 24 freewheels the phase winding 18. Freewheeling then continues indefinitely until such time as the controller 24 commutates the phase winding 18. The controller 24 therefore controls excitation of the phase winding 18 using two parameters: the phase period, T_PHASE, and the conduction period, T_CD. The phase period defines the phase of excitation (i.e. the electrical period or angle at which the phase winding 18 is excited relative to zero-crossings in the back EMF) and the conduction period defines the length of excitation (i.e. the electrical period or angle over which the phase winding 18 is excited).

Figure 11:
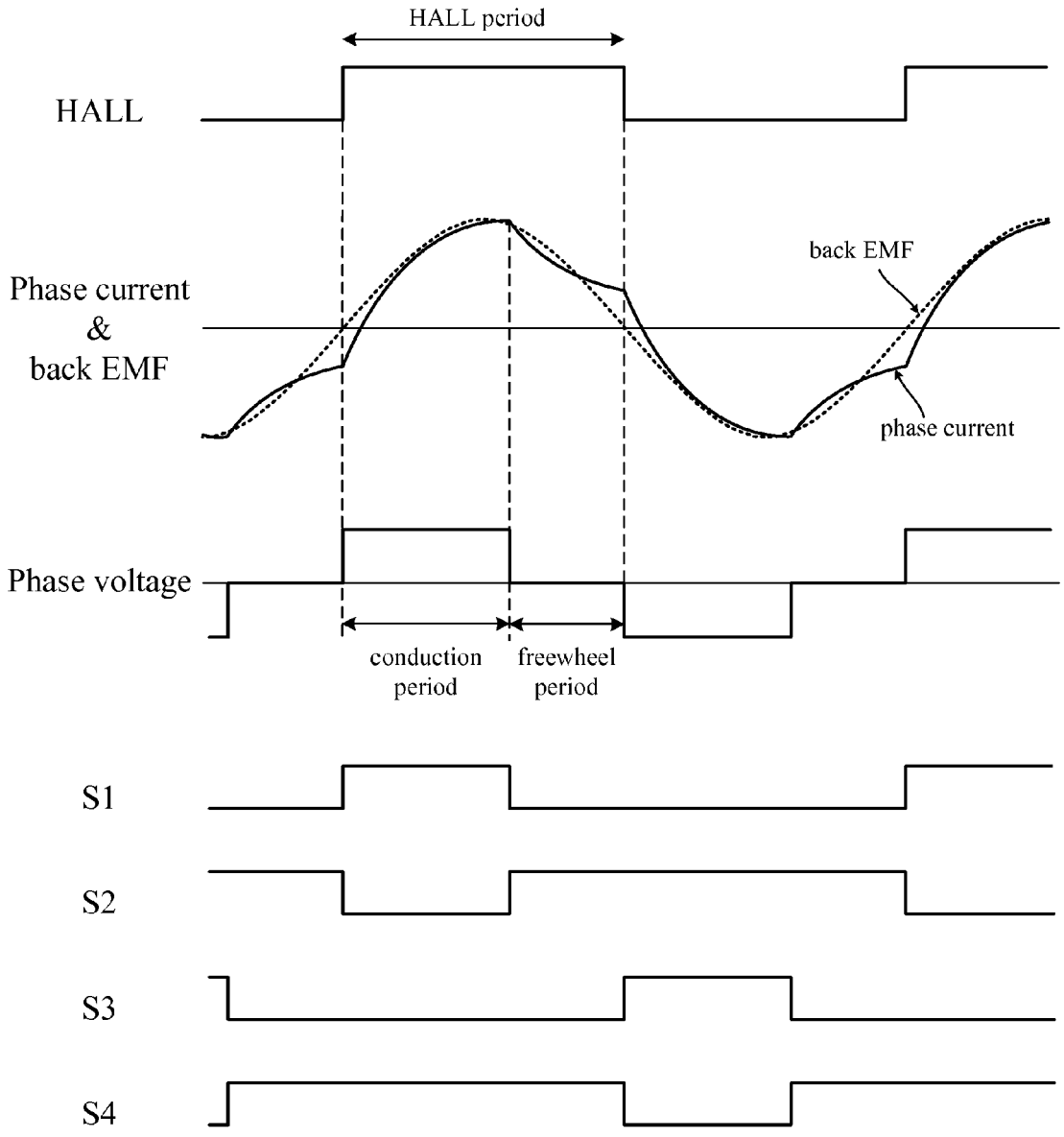
FIG. 11 illustrates various waveforms relating to the brushless motor of the suction source when operating in steady-state mode.

FIG. 11 illustrates the waveforms of the HALL signal, the back EMF, the phase current, the phase voltage, and the control signals S1-S4 over a couple of HALL periods when operating in steady-state mode. In FIG. 11 the phase winding 18 is commutated in synchrony with the HALL edges.

The magnitude of the supply voltage influences the amount of current that is driven into the phase winding 18 during the conduction period. The input and output power of the motor 15 are therefore sensitive to changes in the supply voltage. In addition to the supply voltage, the power of the motor 15 is sensitive to changes in the speed of the rotor 16. As the speed of the rotor 16 varies (e.g. in response to changes in load), so too does the magnitude of the back EMF. Consequently, the amount of current driven into the phase winding 18 during the conduction period may vary. The controller 24 therefore varies the phase period and the conduction period in response to changes in the magnitude of the supply voltage. The controller 24 also varies the phase period in response to changes in the speed of the rotor 16.

The controller 24 stores a voltage lookup table that comprises a phase period, T_PHASE, and a conduction period, T_CD, for each of a plurality of different supply voltages. The controller 24 also stores a speed lookup table that comprises a speed-compensation value for each of a plurality of different rotor speeds and different supply voltages. The lookup tables store values that achieve a particular input power or output power at each voltage and speed point. In the present embodiment, the lookup tables store values that achieve constant output power.

The controller 24 indexes the voltage lookup table using the supply voltage to select a phase period and a conduction period. The controller 24 then indexes the speed lookup table using the rotor speed and the supply voltage to select a speed-compensation value. The V_DC signal output by the voltage sensor 23 provides a measure of the supply voltage, whilst the length of the HALL period provides a measure of the rotor speed. The controller 24 then adds the selected speed-compensation value to the selected phase period so as to obtain a speed-compensated phase period. The commutation period, T_COM, is then obtained by subtracting the speed-compensated phase period from the HALL period, T_HALL.

The speed lookup table stores speed-compensation values that depend not only on the speed of the rotor 16 but also on the magnitude of the supply voltage. The reason for this is that, as the supply voltage decreases, a particular speed-compensation value has a smaller net effect on the power of the motor 15. By storing speed-compensation values that depend on both the rotor speed and the supply voltage, better control over the output power of the motor 15 may be achieved in response to changes in the rotor speed.

It will be noted that two lookup tables are used to determine the phase period, T_PHASE. The first lookup table (i.e. the voltage lookup table) is indexed using the supply voltage. The second lookup table (i.e. the speed lookup table) is indexed using both the rotor speed and the supply voltage. Since the second lookup table is indexed using both rotor speed and supply voltage, one might question the need for two lookup tables. However, the advantage of using two lookup tables is that different voltage resolutions may be used. The output power of the motor 15 is relatively sensitive to the magnitude of the supply voltage. In contrast, the effect that the speed-compensation value has on the output power is less sensitive to the supply voltage. Accordingly, by employing two lookup tables, a finer voltage resolution may be used for the voltage lookup table, and a coarser voltage resolution may be used for the speed lookup table. As a result, relatively good control over the output power of the motor 15 may be achieved through the use of smaller lookup tables, which then reduces the memory requirements of the controller 24.

Control of the Brushed Motor

The peripherals of the controller 24 include a PWM module, which is configured to generate and output the control signal S5. The processor loads the PWM module with a fixed period, and a duty cycle that depends on the supply voltage and the motor current. The control signal S5 is therefore a PWM signal having a fixed period and a variable duty cycle.

As the battery pack 9 discharges, the supply voltage used to power the brushed motor 11,13 decreases. The processor therefore adjusts the duty cycle of the PWM module in response to changes in the supply voltage. More particularly, the processor adjusts the duty cycle of the PWM module such that the input voltage to the brushed motor 11,13 is constant. Since the input voltage is pulsed, the instantaneous voltage naturally changes. Constant voltage should therefore be understood to mean that the input voltage, when averaged over each cycle of the PWM signal, is constant. For a given load, the speed of the brushed motor 11,13 is proportional to the input voltage. Accordingly, by ensuring that the input voltage is constant, the speed of the motor 11,13 is unchanged as the battery pack 9 discharges.

The controller 24 stores a further voltage lookup table that comprises different duty cycles for different voltages. The processor then indexes the further voltage lookup table using the supply voltage provided by the battery pack 9, as determined from the V_DC signal, to select a duty cycle.

During use of the vacuum cleaner 1, the agitator 10,12 and thus the brushed motor 11,13 experience different loading. As a result, the current drawn by the motor 11,13 varies. Owing to Ohmic losses, there is a voltage drop across the power switch 40 and the second current sensor 42 that is sensitive to the magnitude of the current in the motor 11,13. The input voltage to the motor 11,13 is therefore sensitive to changes in load. The controller therefore 24 adjusts the duty cycle in response to changes in the current. However, for reasons that will now be explained, the amount by which the controller 24 adjusts the duty cycle depends not only on the change in the current but also on the magnitude of the supply voltage. When the switch 40 is closed, the voltage drop across the switch 40 and the current sensor 42 is proportional to the motor current, i.e. $V_{drop}=I\times(R_{switch}+R_{sensor})$. However, when the switch 40 is open, the voltage drop across the switch 40 and the current sensor 42 is zero, i.e. $V_{drop}=0$. The voltage drop, when averaged over each cycle of the PWM signal, is therefore proportional to both the motor current and the duty cycle of the PWM signal, i.e.

$$V_{drop}=I\times(R_{switch}+R_{sensor})\times\text{duty cycle}$$

The duty cycle is defined by the magnitude of the supply voltage. Accordingly, when adjusting the duty cycle in response to changes in the motor current, the controller 24 also takes into account the magnitude of the supply voltage. That is to say that, for a given change in motor current, the controller 24 adjusts the duty cycle by an amount that depends on the magnitude of the supply voltage. More particularly, the controller 24 adjusts the duty cycle by a larger amount in response to a lower supply voltage. The controller 24 adjusts the duty cycle such that the input voltage to the motor 11,13 is constant as the motor 11,13 undergoes different loading. As a result, the torque-speed curve for the motor 11,13 does not change as the battery pack 9 discharges.

The controller 24 stores a current lookup table that comprises different compensation values for different currents and different voltages. The controller 24 then indexes the current lookup table using the motor current, as determined from I_BRUSHED, and the supply voltage, as determined from V_DC, to select a compensation value. The controller 24 then adds the selected compensation value to the duty cycle selected from the further voltage lookup table to obtain a compensated duty cycle. The processor then loads the duty cycle register of the PWM module with the compensated duty cycle.

FIGS. 12 and 13 illustrate a portion of the further voltage lookup table and the current lookup table. The further voltage lookup table stores hexadecimal values that are loaded directly into the 8-bit duty-cycle register of the PWM module. However, for the purposes of illustration, the corresponding duty cycle expressed as a percentage is shown along with the resulting input voltage. It can be seen from the voltage lookup table that the controller 24 increases the duty cycle of the PWM signal as the supply voltage decreases. In this particular embodiment, the further voltage lookup table stores values that achieve a constant input voltage of 16.2 V for the brushed motor 11,13. It can be seen from the current lookup table that the controller 24 increases the duty cycle of the PWM signal as the motor current increases. Moreover, for a given current level, the controller 24 adjusts the duty cycle by a larger amount when the supply voltage is lower.

The controller 24 employs two lookup tables to determine the duty cycle. The first lookup table (i.e. the further voltage lookup table) is indexed using the supply voltage. The second lookup table (i.e. the current lookup table) is indexed using both the motor current and the supply voltage. Again, the advantage of using two lookup tables is that different voltage resolutions may be used. The input voltage of the motor 11,13 is highly sensitive to changes in the magnitude of the supply voltage. In contrast, the input voltage of the motor 11,13 is less sensitive to changes in the motor current. Accordingly, by employing two lookup tables, a finer voltage resolution may be used for the further voltage lookup table, and a coarser voltage resolution may be used for the current lookup table. As a result, a constant input voltage may be achieved through the use of smaller lookup tables, which then reduces the memory requirements of the controller 24.

When the brushed motor 11,13 is stationary, a relatively high inrush current will be drawn by the motor 11,13 if the duty cycle of the control signal S5 is relatively high. Accordingly, when the user-operable switch 20 is initially closed, the controller 24 selects a predefined duty cycle stored in memory. This duty cycle is employed only when the switch 20 is initially closed and is significantly lower than the duty cycles stored in the further voltage lookup table. In the present embodiment, the controller 24 initially loads the duty cycle register of the PWM module with the value 0x28, which corresponds to a duty cycle of 15.625%. The controller 24 also determines a target duty cycle by indexing the voltage and current lookup tables. The controller 24 then periodically increments the duty cycle. In the present embodiment, the controller 24 increments the duty cycle register of the PWM module by 0x01 (which corresponds to an increase in duty of 0.390%) roughly every 2.5 ms. The controller 24 continues to periodically increase the duty cycle until the duty cycle is equal to or greater than the target duty cycle, at which point the controller 24 then uses the target duty cycle. By employing a starting duty cycle that is much lower than that employed during steady state, and by periodically increasing the duty cycle as the motor accelerates, inrush current may be avoided.

In the present embodiment, the first cleaner head 3 and the second cleaner head 5 comprise the same type of brushed motor 11,13. Moreover, the two motors 11,13 are driven at the same input voltage. The controller 24 therefore makes no distinction between the two cleaner heads 3,5. However, in an alternative embodiment, it may be desirable to drive the two motors 11,13 at different input voltages. For example, perhaps the two motors 11,13 are different or perhaps the two motors 11,13 are the same but one wishes to drive the motors 11,13 at different speeds. In this instance, the controller 24 may comprise different voltage and current lookup tables for the two brushed motors 11,13. The controller 24 then indexes the appropriate lookup tables according to which cleaner head 3,5 is attached to the main body 2.

Simultaneous Control

The controller 24 generates control signals S1-S4 and S5 for controlling simultaneously the excitation of the brushless motor 15 and the brushed motor 11,13. This is made possible by configuring a PWM module of the controller 24 to generate the control signal S5 for the brushed motor 11,13. The processor of the controller 24 is then free to execute software instructions necessary to generate the control signals S1-S4 for the brushless motor 15. The processor periodically updates the duty cycle of the PWM module. However, this can be done within the main code without adversely interfering with the control and operation of the brushless motor 15.

In a conventional vacuum cleaner, each motor comprises its own controller. With the vacuum cleaner 1 of the present invention, on the other hand, a single controller 24 is used to control both the brushless motor 15 and the brushed motor 11,13. As a result, the cost of the vacuum cleaner 1 is reduced. Moreover, the vacuum cleaner 1 has two interchangeable cleaner heads 3,5, each of which includes a motor 11,13. The cost of the vacuum cleaner 1 is thus further reduced by employing a single controller 24 to control all three motors 11,13,15.

In the embodiment described above, the vacuum cleaner 1 comprises a battery pack 9 that provides the supply voltage. The controller 24 then adjusts the duty cycle of the PWM signal, as well as the lengths of the phase period and the conduction period, in response to changes in the supply voltage. In particular, the controller 24 increases the duty cycle, and the lengths of the phase period and the conduction period, in response to a decrease in the supply voltage. Moreover, the control signals S1-S4 and S5 generated by the controller 24 ensure that, as the battery pack discharges, the input voltage at the brushed motor 11,13 and the output power of the brushless motor 15 are constant. As a result, the performance of the vacuum cleaner 1 (i.e. the suction generated by the suction source 7, and the agitation generated by the cleaner heads 3,5) does not deteriorate as the battery pack 9 discharges. In an alternative embodiment, the supply voltage may be provided by an alternative source. For example, the vacuum cleaner 1 may be powered by a mains power supply. The circuit assembly 8 would then comprise a rectifier and smoothing capacitor that operate on the mains voltage so as to provide a regular supply voltage. Nevertheless, the RMS voltage of the AC source may vary, which might then adversely affect the performance of the vacuum cleaner 1. Accordingly, the controller 24 continues to adjust the duty cycle, the phase period and the condition period in response to changes in the supply voltage so as to maintain a consistent performance.

In the embodiment described above, the controller 24 varies the phase period and the conduction period in response to changes in the supply voltage. This then has the advantage that the efficiency of the brushless motor 15 may be better optimised at each voltage point. Nevertheless, it may be possible to achieve the desired control over the output power of the motor 15 by varying just one of the phase period and the conduction period. For example, it may be desirable to employ synchronous commutation throughout steady-state mode. In this case, the controller 24 would vary just the conduction period in response to changes in the supply voltage.

The invention claimed is:

1. A surface cleaning appliance comprising:

a cleaner head comprising an agitator and a motor for driving the agitator;

a switch coupling the motor to a supply voltage;

a voltage sensor for measuring the magnitude of the supply voltage;

a current sensor for measuring the magnitude of current through the motor; and a controller configured to output a PWM signal for controlling the switch, wherein the controller adjusts the duty cycle of the PWM signal in response to changes in the supply voltage and in response to changes in the current through the motor.

2. The appliance of claim 1, wherein the controller adjusts the duty cycle so as to maintain a constant input voltage to the motor.

3. The appliance of claim 1, wherein the controller increases the duty cycle in response to a decrease in the supply voltage and in response to an increase in the motor current.

4. The appliance of claim 1, wherein in response to a given change in the motor current the controller adjusts the duty cycle by a larger amount when the supply voltage is lower.

5. The appliance of claim 1, wherein the controller stores a voltage lookup table and a current lookup table, the controller indexes the voltage lookup table using the measured supply voltage to select a first value, the controller indexes the current lookup table using the measured motor current to select a second value, and the duty cycle is defined by the sum of the first value and the second value.

6. The appliance of claim 5, wherein the controller indexes the current lookup table using the measured motor current and the measured supply voltage to select the second value.

7. The appliance of claim 1, wherein the controller employs a predefined duty cycle when the motor is stationary, the controller determines a target duty cycle using the measured supply voltage and the measured motor current, and the controller periodically increases the duty cycle by a fixed amount until the duty cycle is equal to or greater than the target duty cycle.

8. The appliance of claim 1, wherein the appliance comprises a battery pack that provides the supply voltage.

9. A surface cleaning appliance comprising:

a cleaner head comprising an agitator and a motor for driving the agitator;

a switch coupling the motor to a supply voltage;

a voltage sensor for measuring the magnitude of the supply voltage;

a current sensor for measuring the magnitude of current through the motor; and a controller configured to output a PWM signal for controlling the switch, wherein the controller increases the duty cycle of the PWM signal in response to a decrease in the supply voltage and in response to an increase in the motor current.

10. The appliance of claim 9, wherein in response to a given change in the motor current the controller adjusts the duty cycle by a larger amount when the supply voltage is lower.

11. A surface cleaning appliance comprising:

a cleaner head comprising an agitator and a motor for driving the agitator;

a switch coupling the motor to a supply voltage;

a voltage sensor for measuring the magnitude of the supply voltage;

a current sensor for measuring the magnitude of current through the motor; and a controller configured to output a PWM signal for controlling the switch, wherein the controller increases the duty cycle of the PWM signal in response to a decrease in the supply voltage and in response to an increase in the motor current so as to maintain a constant input voltage to the motor.

12. The appliance of claim 11, wherein in response to a given change in the motor current the controller adjusts the duty cycle by a larger amount when the supply voltage is lower.

* * * * *